US010589437B2

(12) United States Patent
Amavasai et al.

(10) Patent No.: US 10,589,437 B2
(45) **Date of Patent: *Mar. 17, 2020**

(54) PERSONAL APPLIANCE

(71) Applicant: The Gillette Company LLC, Boston, MA (US)

(72) Inventors: Balasundram Periasamy Amavasai, Reading (GB); Ian Anthony Good, Reading (GB); Faiz Feisal Sherman, Cincinnati, OH (US)

(73) Assignee: The Gillette Company LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/875,180

(22) Filed: Jan. 19, 2018

(65) Prior Publication Data

US 2019/0224866 A1 Jul. 25, 2019

(51) Int. Cl.
*B26B 21/40* (2006.01)
*B26B 19/38* (2006.01)

(52) U.S. Cl.
CPC ..... *B26B 21/4056* (2013.01); *B26B 19/388* (2013.01)

(58) Field of Classification Search
CPC .. B26B 21/405; B26B 21/4056; B26B 19/388
See application file for complete search history.

(56) References Cited

U.S. PATENT DOCUMENTS

| | | | | |
|---|---|---|---|---|
| 6,189,215 | B1 | 2/2001 | Beerwerth et al. | |
| 8,615,886 | B1 | 12/2013 | Childers | |
| 9,126,346 | B2 | 9/2015 | Meier et al. | |
| 9,174,351 | B2 | 11/2015 | Binder | |
| 2002/0116022 | A1* | 8/2002 | Lebouitz | A61B 17/32 606/167 |
| 2004/0098862 | A1* | 5/2004 | Orloff | B26B 21/222 30/41.7 |
| 2007/0050981 | A1* | 3/2007 | Freund | B26B 21/38 30/41.7 |
| 2008/0052912 | A1* | 3/2008 | Barry | A45D 27/29 30/41.7 |

(Continued)

FOREIGN PATENT DOCUMENTS

| | | |
|---|---|---|
| DE | 21201400021 | 7/2016 |
| EP | 2540189 | 1/2013 |

(Continued)

OTHER PUBLICATIONS

English Translation of JP-03218791. (Year: 1991).*
International Search Report PCT/US2019/014172 dated Mar. 15, 2019, 13 pages.

*Primary Examiner* — Jennifer B Swinney
(74) *Attorney, Agent, or Firm* — Kevin C. Johnson

(57) ABSTRACT

A personal appliance. The personal appliance includes a handle having an implement connecting structure. An implement is connected to the implement connecting structure. An implement displacement sensor is positioned in the handle. The implement displacement sensor measures a displacement of the implement relative to a fixed position of the handle. A power source, an acceleration sensor and an angular velocity sensor are positioned in the handle.

18 Claims, 9 Drawing Sheets

(56) References Cited

U.S. PATENT DOCUMENTS

| | | | | |
|---|---|---|---|---|
| 2008/0109973 | A1* | 5/2008 | Farrell | A46B 7/04 15/4 |
| 2008/0168657 | A1* | 7/2008 | Cloke | B26B 21/4056 30/32 |
| 2008/0189953 | A1 | 8/2008 | Jessemey et al. | |
| 2011/0010875 | A1 | 1/2011 | Iwahori et al. | |
| 2012/0167392 | A1 | 7/2012 | Cherian et al. | |
| 2013/0312579 | A1* | 11/2013 | Childers | B26B 21/4056 83/13 |
| 2014/0137883 | A1 | 5/2014 | Rothschild | |
| 2015/0183118 | A1 | 7/2015 | Roth | |
| 2015/0205279 | A1 | 7/2015 | Simeth | |
| 2016/0046028 | A1 | 2/2016 | Meier et al. | |
| 2016/0167241 | A1 | 6/2016 | Goldfarb | |
| 2016/0262521 | A1* | 9/2016 | Kustra | A45D 24/36 |
| 2017/0099199 | A1* | 4/2017 | Bauer | H04L 43/065 |
| 2017/0232624 | A1* | 8/2017 | King | B26B 21/4056 30/34.05 |
| 2018/0024507 | A1 | 1/2018 | Godlieb | |

FOREIGN PATENT DOCUMENTS

| | | | |
|---|---|---|---|
| EP | 2540189 | A1 | 1/2013 |
| EP | 3141151 | | 3/2017 |
| EP | 3141151 | A1 | 3/2017 |
| JP | 03218791 | A * | 9/1991 |
| WO | 20090176415 | A2 | 6/2009 |
| WO | WO 2009/076415 | | 6/2009 |
| WO | WO 2013/061214 | | 5/2013 |
| WO | WO2013061214 | A1 | 5/2013 |

* cited by examiner

PERSONAL APPLIANCE

FIELD OF THE INVENTION

The present invention relates to the field of Internet of Things (IoT) and connected personal appliances and more particularly to a personal appliance having the ability to improve the usage experience of the personal appliance by providing information about the usage experience to the user related to the personal appliance.

BACKGROUND OF THE INVENTION

There are numerous personal appliances used by consumers every day. Examples of such personal appliances include but are not limited to shaving razors, electric shavers, epilators, body scrubbers, toothbrushes and hair brushes. Proper usage techniques of such personal appliances facilitate the overall efficacy of the product providing the user with a more positive experience than he or she would have otherwise experienced. Such positive usage experiences will likely lead to continued product usage. Providing the user with information about proper usage techniques for using personal appliance has been limited.

Razors with sensors have been used to provide information to the user. Razors with proximity sensors or cameras have been used to provide information on blade attrition. Razors with force sensors have been used to provide the user with information on the amount of force being applied to the skin. By tracking the force being applied during the shave provides a metric to gauge blade dulling and predict blade attrition. Razors having sensors to count shaving strokes have been used to again assist with blade attrition. Cameras have been used to provide users with boundary indicators such as distinguishing between areas of long hair such as side burns adjacent to areas of shorter hair length.

While these existing sensors do assist in providing the user with some basic information they fall well short of providing the usage information needed for an improved shave. To provide the user with the necessary usage information for an improved shave, the razor or personal appliance needs to have sensors that provide the user with useful information and/or data about the user's shave. With the useful information and/or data about user's shave the user can see how he or she is shaving and can discover ways to improve the shave.

Similarly, providing useful usage information and/or data about the usage experience regarding other personal appliances such as grooming appliances, cosmetic appliances and beauty appliances enables the user to see how they are currently using the device and discover ways to improve their usage of the personal appliance.

SUMMARY OF THE INVENTION

The present invention relates to a personal appliance. The personal appliance comprises a handle comprising an implement connecting structure; an implement connected to the implement connecting structure; an implement displacement sensor positioned in the handle, the implement displacement sensor measuring a displacement of the implement relative to a fixed position of the handle; a power source positioned in the handle; an acceleration sensor positioned in the handle; an angular velocity sensor positioned in the handle; and a communication device positioned in the handle.

The acceleration sensor may comprise an accelerometer.

The angular velocity sensor may comprise a gyroscope.

The pitch and roll of the handle can be calculated from the data from the acceleration sensor and angular velocity sensor. Yaw can also be calculated from the data from the acceleration sensor and the angular velocity sensor.

The personal appliance may further comprise a magnetic field sensor positioned in the handle. The magnetic field sensor may comprise a magnetometer.

The pitch, roll and yaw of the handle can be calculated from the data from the magnetic field sensor, the acceleration sensor and the angular velocity sensor.

The implement displacement sensor may comprise a magnetometer, an optical sensor, a switch, a Hall Effect sensor, a capacitive sensor, a load sensor or a displacement sensor.

The communication device may comprise an LED display, an LCD display, a wireless connection, a wired connection, a removable memory card, a vibration device, microphone and/or an audio device.

The power source may comprise a rechargeable battery, a disposable battery or a corded electrical connection.

The personal appliance may further comprise a clock positioned in the handle. The clock may comprise a crystal oscillator, a ceramic oscillator or an RC oscillator.

The personal appliance may further comprise a memory storage device positioned in the handle. The memory storage device may comprise a non-volatile flash memory, a non-volatile flash memory card, a hard disk and/or a volatile DRAM.

The personal appliance may further comprise an on/off switch for controlling power from the power supply to the acceleration sensor, the angular velocity sensor, the magnetic field sensor, the implement displacement sensor and/or the communication device. The on/off switch may comprise a mechanical switch, an electronic switch, a capacitive sensor, an accelerometer based trigger, a magnetic reed switch, an optical sensor, or an acoustic sensor.

The personal appliance may further comprise at least one temperature sensor positioned in the handle.

The personal appliance may further comprise a barometric pressure sensor positioned in the handle.

The personal appliance may further comprise a RFID sensor positioned in the handle.

The personal appliance may comprise a grooming appliance, a cosmetic appliance, a beauty appliance and an oral care appliance.

The implement may comprise at least one sensor.

The communication device may communicate with a second device. The second device may comprise a mobile phone, a computer application, a computer or an electronic device.

The implement displacement sensor may measure a linear displacement or a rotational displacement.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
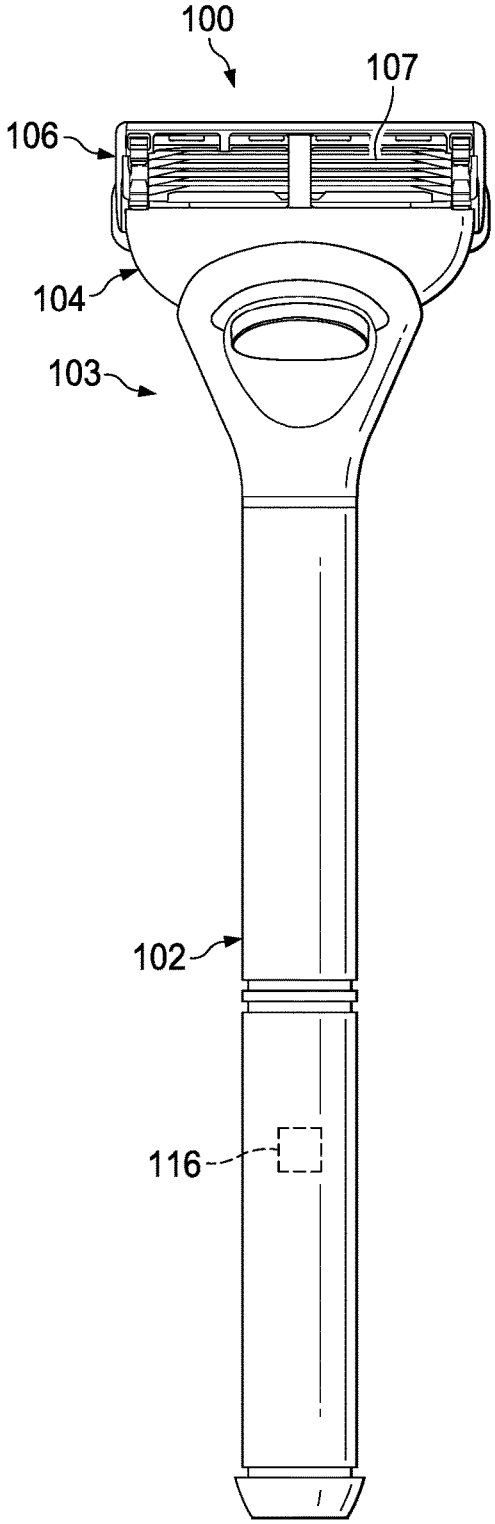
FIG. 1 is a view of a razor including a handle of the present invention.

Referring now to FIGS. 1-4 there is shown a personal appliance 100. The personal appliance 100 shown is a shaving razor 103. The shaving razor 103 is just one example of a personal appliance of the present invention. Examples of other personal appliances of the present invention include grooming devices such as an electric shaver, a cosmetic appliance, a beauty appliance, and an oral care appliance.

The shaving razor 103 comprises a handle 102. The handle 102 comprises an implement connecting structure 105. An implement 104 is connected to the implement connecting structure 105. The implement 104 shown is a razor cartridge 106. The razor cartridge 106 includes at least one blade 107 for cutting hair. The razor cartridge 106 shown includes five blades 107. Any number of blades 107 may be used for a razor cartridge design.

An implement displacement sensor 114 is positioned in the handle 102. The implement displacement sensor 114 measures a displacement of the implement 104 relative to a fixed position of the handle 102. A power source 118 is positioned in the handle 102. An acceleration sensor 110 is positioned in the handle 102. An angular velocity sensor 112 is positioned in the handle 102. A communication device 116 is positioned in the handle.

Figure 4:
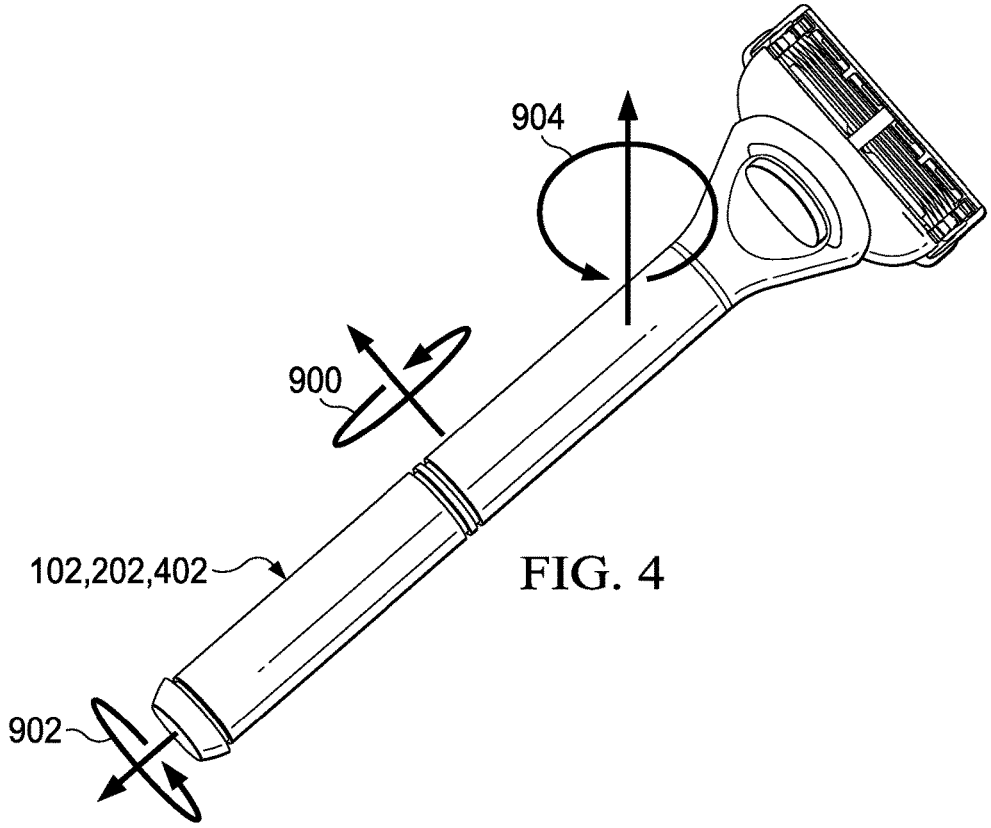
FIG. 4 is a perspective view showing the pitch, roll and yaw of a handle of a personal appliance of the present invention.
Figure 5:
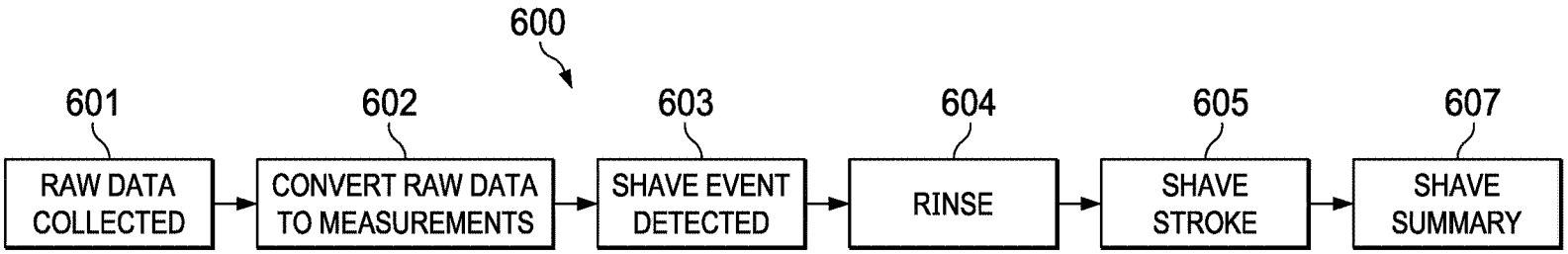
FIG. 5 is a plan diagram of the collected shave data and associated algorithms.

The acceleration sensor 110 preferably comprises an accelerometer 111. The accelerometer 111 measures the proper acceleration of the handle 102. The angular velocity sensor 112 preferably comprises a gyroscope 113. The gyroscope 113 measures the rotation or angular velocity of the handle 102. Together data from the acceleration sensor 110 and the angular velocity sensor 112 can be used to calculate the pitch and roll of the handle 102. Referring to FIG. 4, the pitch 900 and the roll 902 of the handle 102 are shown. The yaw 904 can also be calculated with data from the acceleration sensor 110 and the angular velocity sensor 112.

The implement displacement sensor 114 may take on many forms. Suitable implement displacement sensors 114 comprise a magnetometer, an optical sensor, a switch, a Hall Effect sensor, a capacitive sensor, a load sensor and a displacement sensor. The implement displacement sensor 114 is useful to detect and measure contact of the implement with a user's body. During use of shaving razor 103 the implement displacement sensor 114 located in handle 102 detects and measures contact of razor cartridge 106 with a user's body. Such contact measurement is an indication that the shaving razor 103 is in use as the razor cartridge 106 is in contact with the user's body.

The implement displacement sensor 114 comprises a magnet 160 embedded in follower 163 and a magnetometer 161 contained within handle 102. As the user shaves, razor cartridge 106 rotates or pivots as it contacts the users skin. As the razor cartridge 106 rotates it pushes on follower 163 causing follower 163 to move inward into handle 102. As follower 163 moves inward into handle 102, magnet 160 moves closer to magnetometer 161. Follower 163 converts the rotational movement of the cartridge 106 into a linear displacement of the magnet 160 relative to handle 102. The amount of linear displacement of follower 163 directly correlates to the rotational displacement of razor cartridge 106 relative to a fixed position on handle 102. The implement displacement sensor 114 measures the change in magnetic field associated with the movement of magnet 160 relative to magnetometer 161.

While the implement displacement sensor 114 measures a linear displacement of magnet 160 relative to a fixed position on handle 102, implement displacement sensor 114 can also be used to determine a rotational displacement of razor cartridge 106 relative to a fixed position on handle 102.

Figure 3:
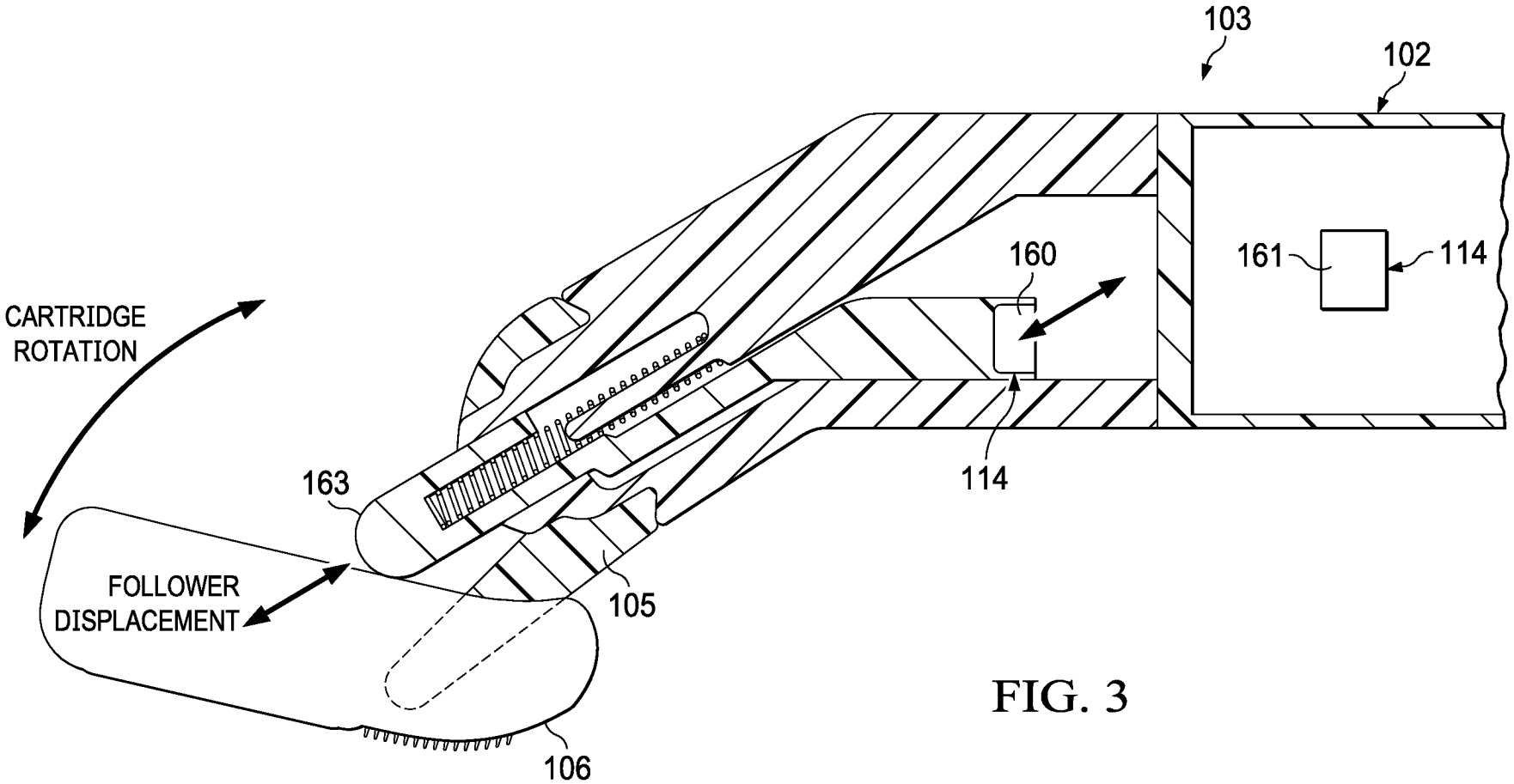
FIG. 3 is a cut away view of a personal appliance showing the displacement sensor.
Figure 3A:
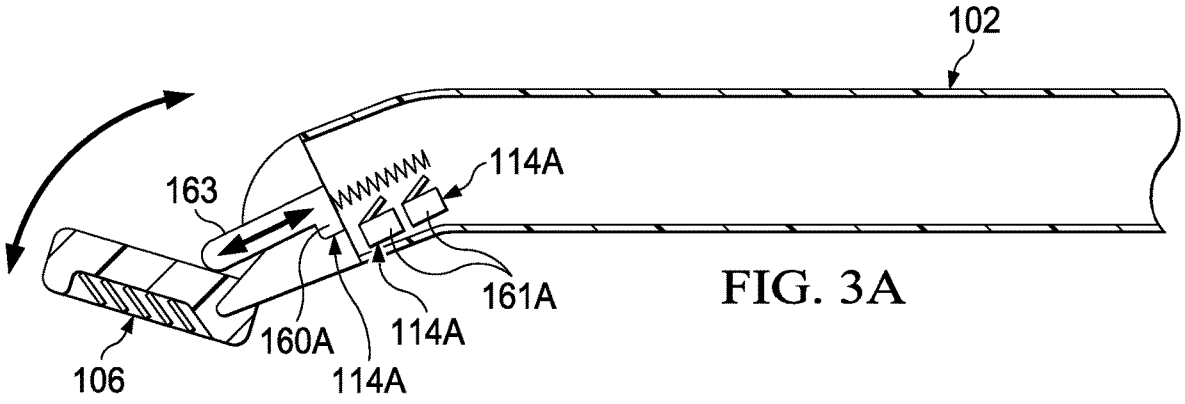
FIGS. 3A-3E are cut away views of personal appliances showing different displacement sensors of the present invention.

Referring now to FIG. 3A there is shown a cut away view of a personal appliance showing a displacement sensor 114A. The implement displacement sensor 114A comprises a mechanical feature 160A at the end of follower 163 and a series of switches 161A contained within handle 102. As the user shaves, razor cartridge 106 rotates or pivots as it contacts the users skin. As the razor cartridge 106 rotates it pushes on follower 163 causing follower 163 to move inward into handle 102. As follower 163 moves inward into handle 102, mechanical feature 160A moves over switches 161A causing them to close in succession with the increase in inward movement of follower 163. Follower 163 converts the rotational movement of the cartridge 106 into a linear displacement of the mechanical feature 160A relative to handle 102. The amount of linear displacement of follower 163 directly correlates to the rotational displacement of razor cartridge 106 relative to a fixed position on handle 102. The implement displacement sensor 114A measures the change in linear distance associated with the movement of mechanical feature 160A relative to switches 161A.

While the implement displacement sensor 114A measures a linear displacement of mechanical feature 160A relative to a fixed position on handle 102, implement displacement sensor 114A can be used to determine a rotational displacement of razor cartridge 106 relative to a fixed position on handle 102.

Figure 3B:
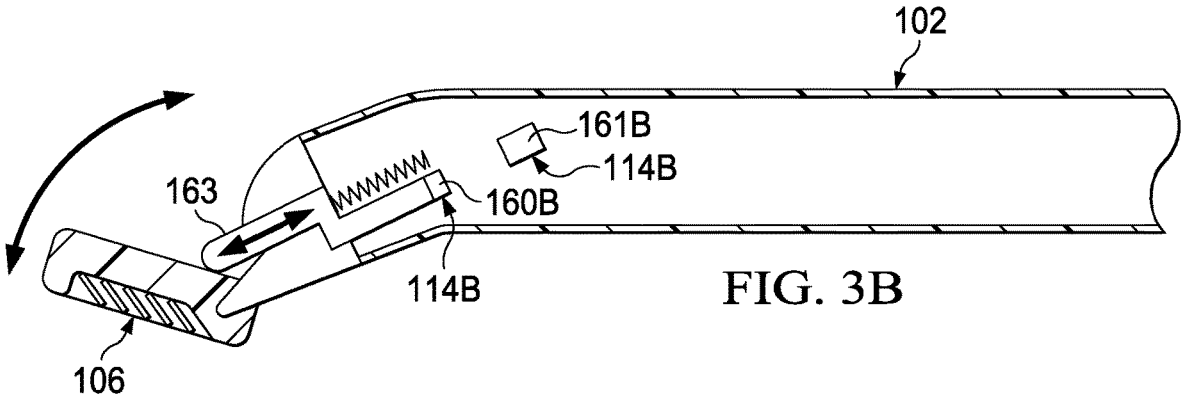

Referring now to FIG. 3B there is shown a cut away view of a personal appliance showing a displacement sensor 114B. The implement displacement sensor 114B comprises a magnet 160B at the end of follower 163 and a Hall Effect sensor 161B contained within handle 102. As the user shaves, razor cartridge 106 rotates or pivots as it contacts the users skin. As the razor cartridge 106 rotates it pushes on follower 163 causing follower 163 to move inward into handle 102. As follower 163 moves inward into handle 102, magnet 160B moves closer to Hall Effect sensor 161B. Follower 163 converts the rotational movement of the cartridge 106 into a linear displacement of the magnet 160 relative to handle 102. The amount of linear displacement of follower 163 directly correlates to the rotational displacement of razor cartridge 106 relative to a fixed position on handle 102. The implement displacement sensor 114B measures the change in magnetic field associated with the movement of magnet 160B relative to Hall Effect sensor 161B.

While the implement displacement sensor 114B measures a linear displacement of magnet 160B relative to a fixed position on handle 102, implement displacement sensor 114B can also be used to determine a rotational displacement of razor cartridge 106 relative to a fixed position on handle 102.

Figure 3C:
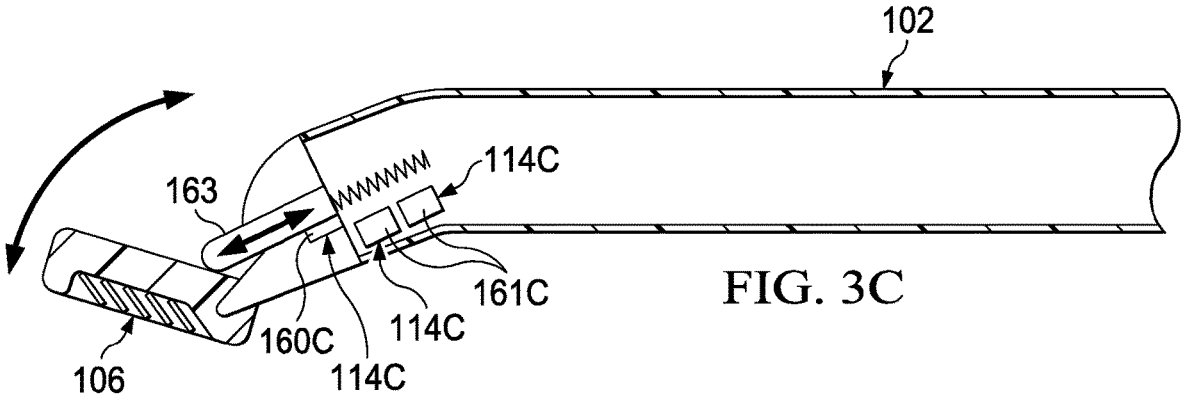

Referring now to FIG. 3C there is shown a cut away view of a personal appliance showing a displacement sensor 114C. The implement displacement sensor 114C comprises a material 160C that modifies the capacitive field at the end of follower 163 and a series of capacitive sensors 161C contained within handle 102. As the user shaves, razor cartridge 106 rotates or pivots as it contacts the users skin. As the razor cartridge 106 rotates it pushes on follower 163 causing follower 163 to move inward into handle 102. As follower 163 moves inward into handle 102, material 160C moves over capacitive sensors 161C causing them to close in succession with the increase in inward movement of plunger 163. Follower 163 converts the rotational movement of the cartridge 106 into a linear displacement of the capacitively conductive material 160C relative to handle 102. The amount of linear displacement of follower 163 directly correlates to the rotational displacement of razor cartridge 106 relative to a fixed position on handle 102. The implement displacement sensor 114C measures the change in linear distance associated with the movement of material 160C relative to capacitive sensors 161C.

While the implement displacement sensor 114C measures a linear displacement of capacitively conductive material 160C relative to a fixed position on handle 102, implement displacement sensor 114C can be used to determine a rotational displacement of razor cartridge 106 relative to a fixed position on handle 102.

Figure 3D:
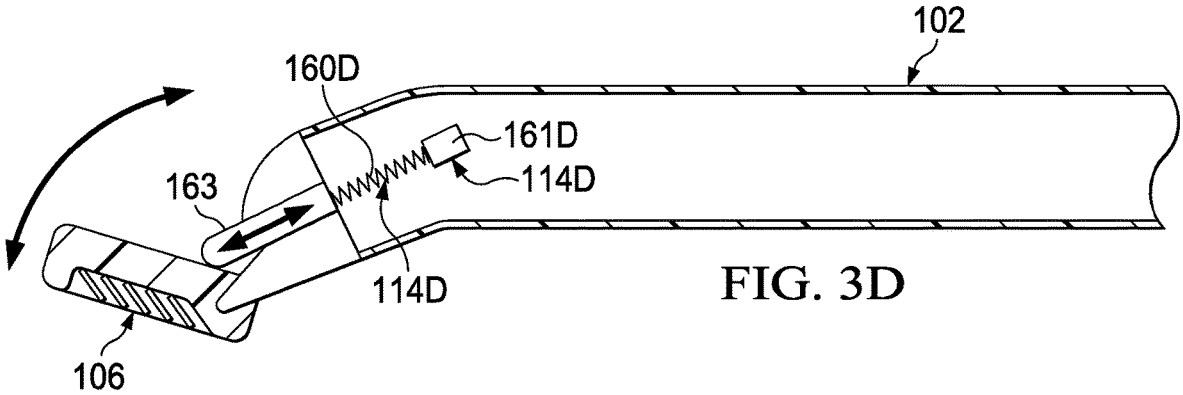

Referring now to FIG. 3D there is shown a cut away view of a personal appliance showing a displacement sensor 114D. The implement displacement sensor 114D comprises a spring 160D secured to the end of follower 163 and a load sensor 161D contained within handle 102. As the user shaves, razor cartridge 106 rotates or pivots as it contacts the users skin. As the razor cartridge 106 rotates it pushes on follower 163 causing follower 163 to move inward into handle 102. As follower 163 moves inward into handle 102, the load on spring 160D is increased and detected by load sensor 161D. Follower 163 converts the rotational movement of the cartridge 106 into a load on spring 160D relative to handle 102. The amount of load on spring 160D 163 directly correlates to the rotational displacement of razor cartridge 106 relative to a fixed position on handle 102. The implement displacement sensor 114D measures the change in load associated with the load on spring 160D which is detected by load sensor 161D.

While the implement displacement sensor 114D measures a load on spring 160D and determines a linear displacement of cartridge 106 relative to a fixed position on handle 102, implement displacement sensor 114DB can also be used to determine a rotational displacement of razor cartridge 106 relative to a fixed position on handle 102 based on the measured load on load sensor 161D.

Figure 3E:
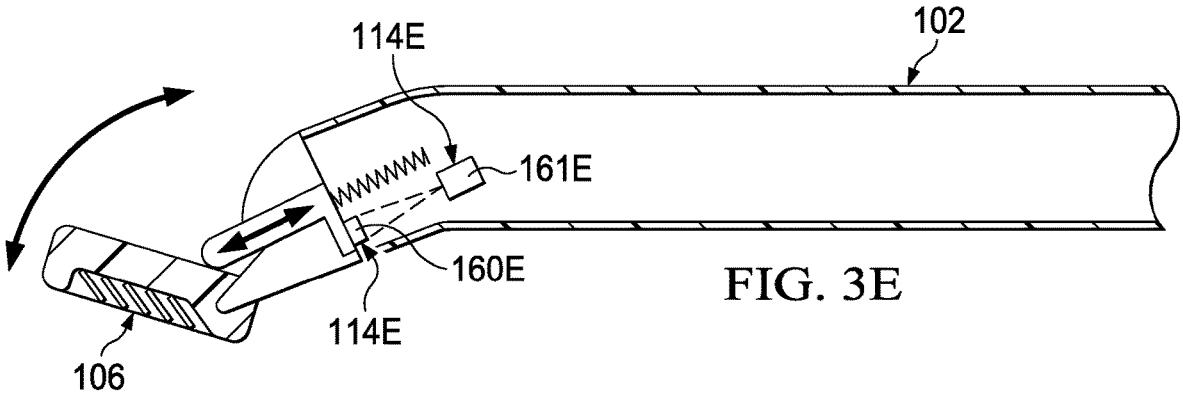

Referring now to FIG. 3E there is shown a cut away view of a personal appliance showing a displacement sensor 114E. The implement displacement sensor 114E comprises a visual marker 160E at the end of follower 163 and an optical sensor 161E contained within handle 102. As the user shaves, razor cartridge 106 rotates or pivots as it contacts the users skin. As the razor cartridge 106 rotates it pushes on follower 163 causing follower 163 to move inward into handle 102. As follower 163 moves inward into handle 102, visual marker 161E moves closer to optical sensor 161E. Follower 163 converts the rotational movement of the cartridge 106 into a linear displacement of the visual marker 160E relative to handle 102. The amount of linear displacement of follower 163 directly correlates to the rotational displacement of razor cartridge 106 relative to a fixed position on handle 102. The implement displacement sensor 114E measures the change in linear distance associated with the movement of visual marker 160E which is detected by optical sensor 161E.

While the implement displacement sensor 114E measures a linear displacement of visual marker 160E relative to a fixed position on handle 102, implement displacement sensor 114E can be used to determine a rotational displacement of razor cartridge 106 relative to a fixed position on handle 102.

The communication device 116 may take on many forms. Suitable communication devices 116 comprise an LED display, an LCD display, a wired connection, a memory card which may be removable, a vibration device, a microphone, an audio device and/or a wireless connection such as, a Wi-Fi connection, a SIM card with GSM connection, a Bluetooth transmitter, a Li-Fi connection, and an infra-red transmitter. The communication device 116 allows the personal appliance 100 to communicate with a user and/or a second device 180. The second device 180 comprises a communication device 116A that can communicate with communication device 116. The communication with a second device 180 may be wirelessly through a cloud architecture and wirelessly to the second device. The communication may be directly to a second device. The second device 180 may be a mobile phone, a computer application, a computer, an electronic device or a base for holding the razor. The communication device 116 may be mounted on the handle such that it is visible to the user. For example, the communication device 116 may comprise an LED display mounted on the handle to be visible to the user as shown in FIG. 1.

The power source 118 may take on many forms. Suitable power sources 118 comprise a rechargeable battery, a disposable battery and a corded electrical connection. The power source 118 powers the various sensors located in the handle 102 requiring power to operate. The power source may power the acceleration sensor 110, the angular velocity sensor 112, the implement displacement sensor 114 and/or the communication device 116.

Figure 1A:
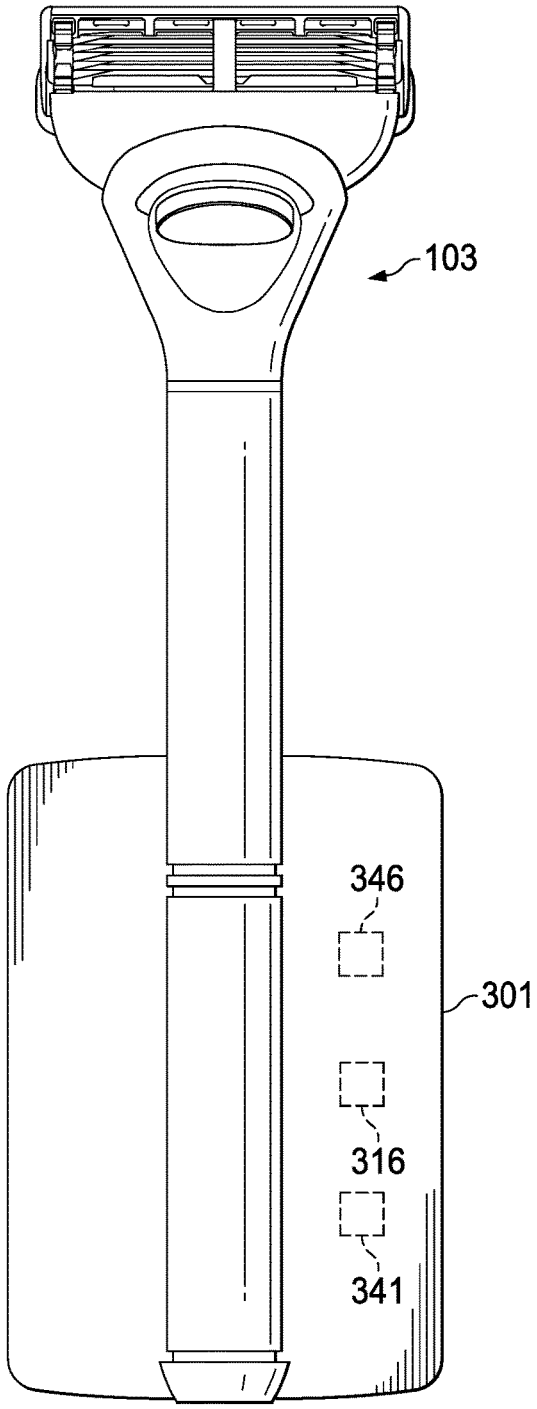
FIG. 1A is a view of a razor and a base of the present invention.
Figure 2:
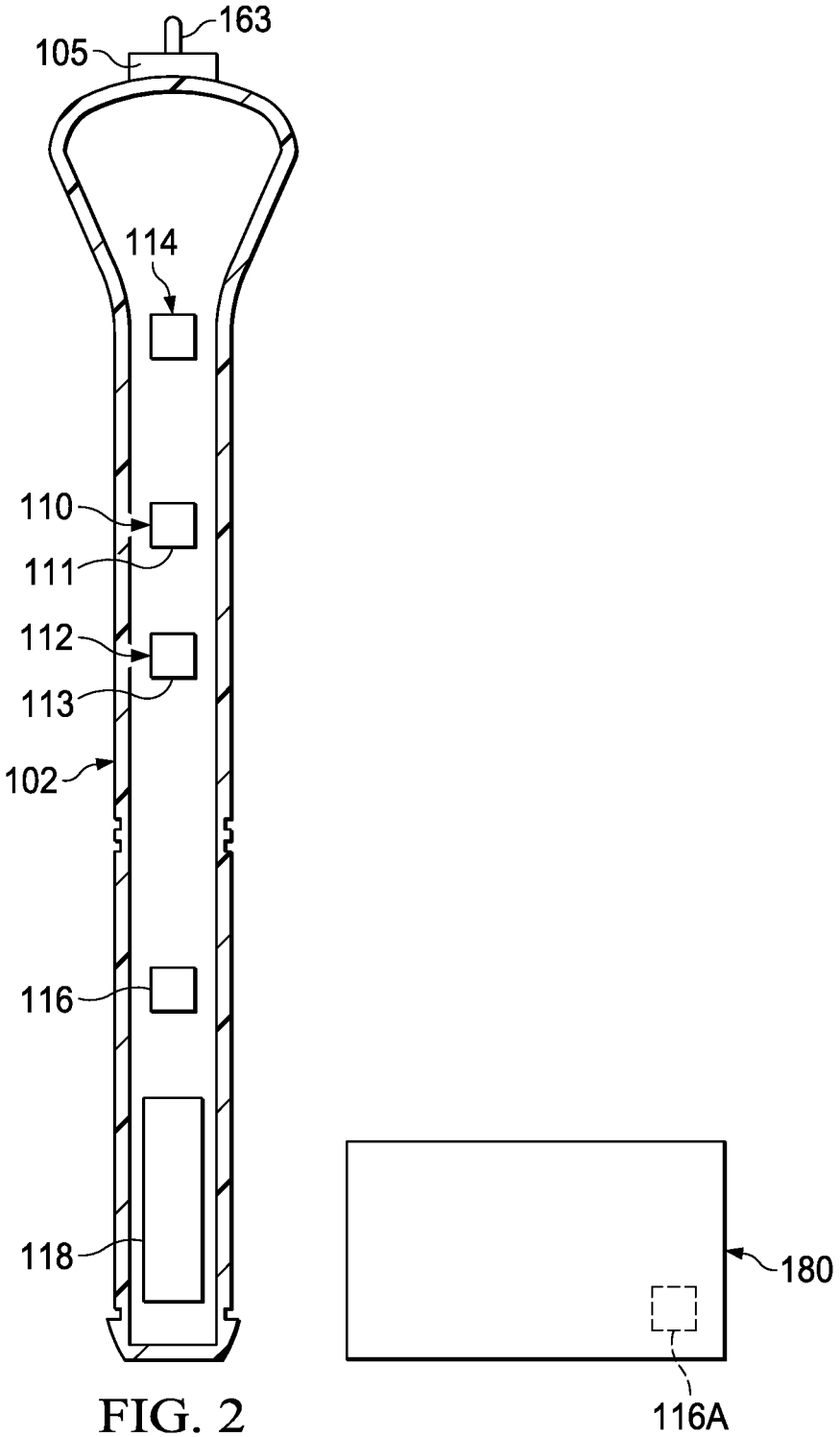
FIG. 2 is a cut away view of a handle for a personal appliance and a second device of the present invention.

The shaving razor 103 may be held in base 301 when not in use as shown in FIG. 1A. Base 301 may serve as a charging station for a rechargeable power source in shaving razor 103. The base 301 comprises a communication device 316. The communication device 316 communicates with communication device 116 in shaving razor 103. Communication device 316 may be mounted in base 301 so that it is visible to the user to provide direct communication to the user. Communication device 316 may also communicate with a second device such as second device 180 shown in FIG. 2. The base 301 may also comprise a memory storage device 341 and a microprocessor 346. The memory storage device 341 can store the collected data from shaving 103 where it can then be processed by microprocessor 346.

In use, the user will grasp handle 102 of shaving razor 103. The power source 118 will power up and power the sensors needing power. The power source 118 may power up automatically upon contact with or movement by user. Alternatively, the power source 118 may power up via an on/off switch. Alternatively, the power source 118 may be constantly on and preferably in a power save mode while not in use and then in full power mode when in use. The user will then shave with shaving razor 103.

As the user shaves, data is collected from the acceleration sensor 110, the angular velocity sensor 112, and the implement displacement sensor 114. The data collected can be used to calculate the pitch and roll of the handle 102 as well as contact data. The data collected may also be used to calculate pressure exerted on the razor cartridge 106, speed of movement of razor cartridge 106, the number and length of each shaving stroke experienced by razor cartridge 106, and the total distance or mileage the razor cartridge 106 has experienced at any given point in time. When the user is finished shaving the shaving razor 103 is put down and data collection stops. The collected data may be transmitted instantaneously as the data is collected via the communication device 116. Alternatively, the collected data is transmitted after the data from a single shaving event or multiple shaving events has been collected via the communication device 116. The data whether transmitted instantaneously or after a period of time can be transmitted through the communication device 116. The communication may be in the form of a color coming from an LED, such as yellow indicating that the pressure being exerted on the razor cartridge 106 is getting near a maximum pressure that is to be exerted on razor cartridge 106 and red indicating that the pressure being exerted on the razor cartridge 106 is exceeding the maximum pressure that is to be exerted on razor cartridge 106.

Referring now to FIGS. 5 and 1-4 there is shown a plan diagram 600 of the collected data and algorithms used with shaving razor 103. With the power source 118 on raw data is collected 601 during the shave event from acceleration sensor 110, angular velocity sensor 112 and implement displacement sensor 114. The raw data is then converted into measurements at 602. The measurements may be made by a logistics device such as microprocessor. The microprocessor may be located within the handle. Alternatively, the raw data can be sent from communication device 116 to an external device such as a mobile phone, a computer application, a computer or electronic device. At 603 the shave event including the presence of a razor cartridge on the handle is detected from the raw data of the acceleration sensor 110, angular velocity sensor 112 and implement displacement sensor 114 using an algorithm. The algorithm may comprise of monitoring the displacement of the implement displacement sensor 114 while the razor is in a static condition to detect the presence of razor cartridge 106 connected to the handle 102 via the implement connecting structure 105. The displacement sensor will reset from a baseline position where no razor cartridge 106 is attached and the follower 163 is in a fully extended position to a first position where the displacement is in a new at rest position different from the baseline position as the follower is no longer in a fully extended position with the razor cartridge attached as the follower contacts the razor cartridge. The algorithm may comprise of monitoring the activity strength as recorded by implement displacement sensor 114 or angular velocity sensor 112 or acceleration sensor 110. For example, if a user starts shaving there would be activation of the implement displacement sensor 114 when shaving razor 103 touches the skin on the user's face. With activation of the angular velocity sensor 112 or acceleration sensor 110 and no activation of the implement displacement sensor 114 the event would be rejected as a shave. The same logic can be used to determine if razor cartridge 106 has been ejected by looking for a signal on implement displacement sensor 114. Also, it can be understood that time between signals and events can be used to determine actions like re-application of shave cream.

At 604 a rinse of the razor cartridge 106 can be detected from the raw data of the acceleration sensor 110, angular velocity sensor 112, and implement displacement sensor 114 using an algorithm. A simple algorithm such as a decision tree (or ensemble of trees), logistic regression, or a recurrent neural network (RNN) can be trained by supervised learning to predict rinse versus no rinse using one or more of the sensor inputs. In some cases, like in RNN, raw sensor signals can be fed into the train model. In other case like decision trees features like mean, standard deviations, etc. can be calculated to feed into the trained model for prediction.

At 605 a shave stroke can be detected from the raw data of the implement displacement sensor 114, acceleration sensor 110, and angular velocity sensor 112 using an algorithm. An algorithm looking at activation of implement displacement sensor 114 in combination with a certain activity level of angular velocity sensor 112 or acceleration sensor 110 to indicate expected motion that represents a shave stroke.

At 607 a summary of the shave can be generated from a combination of 602, 603, 604, and 605. 607 can also be fused with other information directly from the consumer to add an extra level of context such as which strokes were made in the direction of the hair grain. Information from either 602, 603, 604, or 605 and the user input providing information on what direction is their hair growing on a location of their face.

Figure 6:
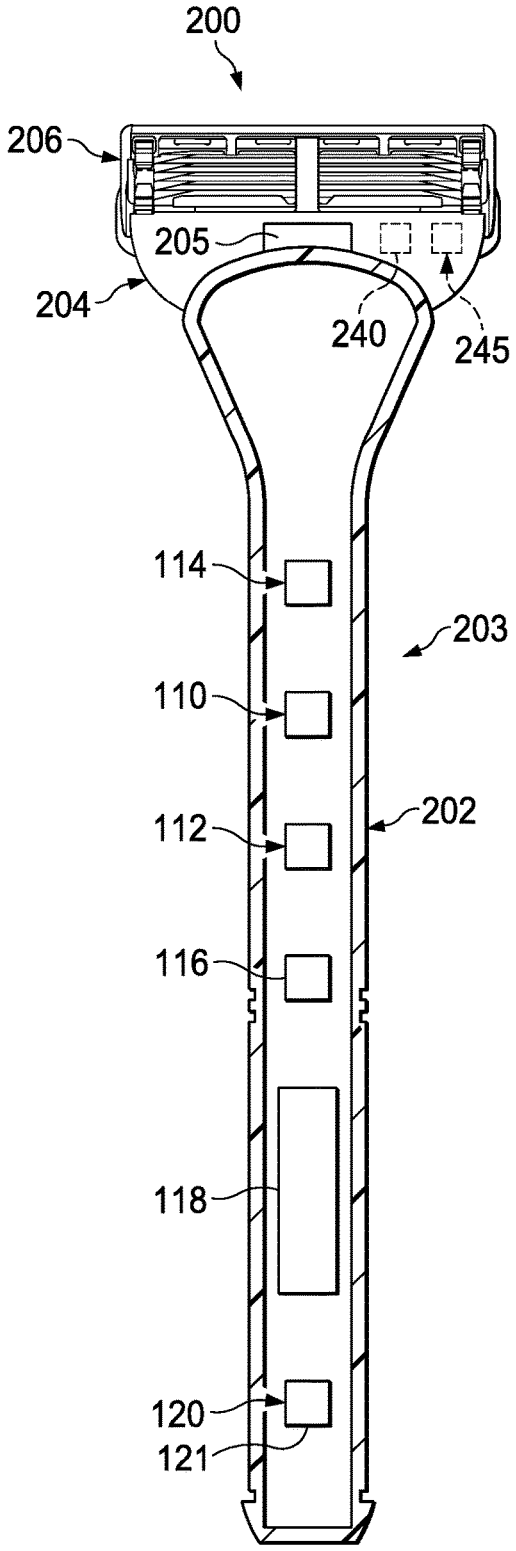
FIG. 6 is a cut away view of a handle for a personal appliance of the present invention.

Referring now to FIGS. 4 and 6, there is shown another personal appliance 200. Personal appliance 200 comprises shaving razor 203. Shaving razor 203 includes implement 204, in this case razor cartridge 206 connected to implement connecting structure 205 of handle 202. Like the handle 102 shown in FIGS. 1 and 2, handle 202 comprises an acceleration sensor 110 positioned in the handle, an angular velocity sensor 112 positioned in the handle, an implement displacement sensor 114 positioned in the handle, a communication device 116 positioned in the handle, and a power source 118 positioned in the handle. Handle 202 also comprises a magnetic field sensor 120 positioned in the handle. The magnetic field sensor 120 measures the magnetic field to find the position of magnetic north and thus determine orientation of the handle 202. The magnetic field sensor 120 preferably comprises a magnetometer 121. The data from the magnetic field sensor 120, the acceleration sensor 110 and the angular velocity sensor 112 can be used to calculate the pitch, a roll and a yaw of the handle 200. Referring to FIG. 4 the pitch 900, the roll 902 and the yaw 904 of handle 202 are shown.

The shaving razor 230 may comprise one or more sensors 240 associated with the implement 204. The one or more sensors 240 associated with the implement 204 may comprise a switch, an acceleration sensor, a magnetic field sensor, an angular velocity sensor, a velocity sensor, a distance sensor, a proximity sensor, a displacement sensor, a capacitive sensor, an electrical conductance sensor, an electrical resistance sensor, an electrical current sensor, a load sensor, a strain sensor, a friction sensor, a fluid flow sensor, pressure sensor, an atmospheric pressure sensor, a temperature sensor, an optical sensor, an infrared sensor, an acoustic sensor, a vibration sensor, a humidity sensor, a chemical sensor, a particle detector, a bio sensor, an RFID sensor, a NFC sensor and/or a wireless receiver.

The method may further comprise a sensor 245 for detecting the presence of the implement 204 on the handle 202.

In use, the user will grasp handle 200 of shaving razor 203. The power source 118 will power up and power the sensors needing power. The power source 118 may power up automatically upon contact with or movement by user. Alternatively, the power source 118 may power up via an on/off switch. Alternatively, the power source 118 may be constantly on and preferably in a power save mode while not in use and then in full power mode when in use. The user will then shave with shaving razor 103. As the user shaves data is collected from the acceleration sensor 110, the angular velocity sensor 112, the implement displacement sensor 114 and the magnetic field sensor 120. The data collected may be used to calculate the pitch, roll and yaw data as well as contact data. When the user is finished shaving the shaving razor 203 is put down and data collection stops. The collected data may be transmitted instantaneously as the data is collected via the communication device 116. Alternatively, the collected data is transmitted after the data from a single shaving event or multiple shaving events has been collected via the communication device 116.

Figure 7:
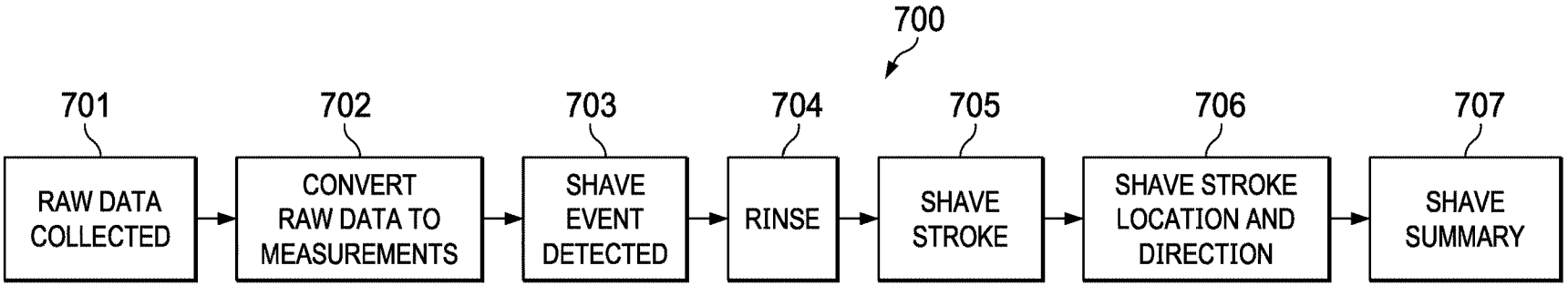
FIG. 7 is a plan diagram of collected shave data and associated algorithms.

Referring now to FIGS. 7 and 6 there is shown a plan diagram 700 of the collected data and algorithms used with handle 202 of shaving razor 203. With the power source 118 on raw data is collected 701 during the shave from acceleration sensor 110, angular velocity sensor 112, implement displacement sensor 114 and magnetic field sensor 120. The raw data is then converted into measurements at 702. The measurements may be made by a logistics device such as microprocessor. The microprocessor may be located within the handle. Alternatively, the raw data can be sent from communication device 116 to an external device such as a mobile phone, a computer application, a computer or electronic device. At 703 the shave event is detected from the raw data of the acceleration sensor 110, angular velocity sensor 112 and implement displacement sensor 114 using an algorithm. The algorithm may comprise of monitoring the activity strength as recorded by implement displacement sensor 114 or angular velocity sensor 112 or acceleration sensor 110. For example, if a user starts shaving there would be activation of the implement displacement sensor 114 when razor cartridge 206 touches the skin on the user's face. With activation of the angular velocity sensor 112 or acceleration sensor 110 and no activation of the implement displacement sensor 114 the event would be rejected as a shave. The same logic can be used to determine if razor cartridge 206 has been ejected by looking for a signal on implement displacement sensor 114. Also, it can be understood that time between signals and events can be used to determine actions like re-application of shave cream.

At 704 a rinse of the razor cartridge 206 can be detected from the raw data of the acceleration sensor 110, angular velocity sensor 112, and implement displacement sensor 114 using an algorithm. A simple algorithm such as a decision tree (or ensemble of trees), logistic regression, or a recurrent neural network (RNN) can be trained by supervised learning to predict rinse versus no rinse using one or more of the sensor inputs. In some cases, like in RNN, raw sensor signals can be fed in to train the model. In other case like decision trees features like mean, standard deviations, etc. can be calculated to feed into the trained model for prediction.

At 705 a shave stroke can be detected from the raw data of the implement displacement sensor 114, acceleration sensor 110, and angular velocity sensor 112 and magnetic field sensor 120 using an algorithm. An algorithm looking at activation of implement displacement sensor 114 in combination with a certain activity level of angular velocity sensor 112 or acceleration sensor 110 to indicate expected motion that represents a shave stroke.

At 706 a shave stroke location and direction can be detected from the raw data of the implement displacement sensor 114, acceleration sensor 110, angular velocity sensor 112 and magnetic field sensor 120 using an algorithm. An algorithm such as a decision tree (or ensemble of trees), logistic regression, or a recurrent neural network (RNN) can be trained by supervised learning to predict location on the user's face using one or more of the sensor inputs. In some cases, like in RNN, raw sensor signals can be fed in to train the model. In other case like decision trees features like mean, standard deviations, etc. can be calculated to feed into the trained model for prediction.

At 707 a summary of the shave can be generated from a combination of 702, 703, 704, 705 and 706. 707 can also be fused with other information directly from the consumer to add an extra level of context such as which strokes were made in the direction of the hair grain. Information from either 702, 703, 704, 705 or 706 and the user input providing information on what direction is their hair growing on a location of their face.

Figure 8:
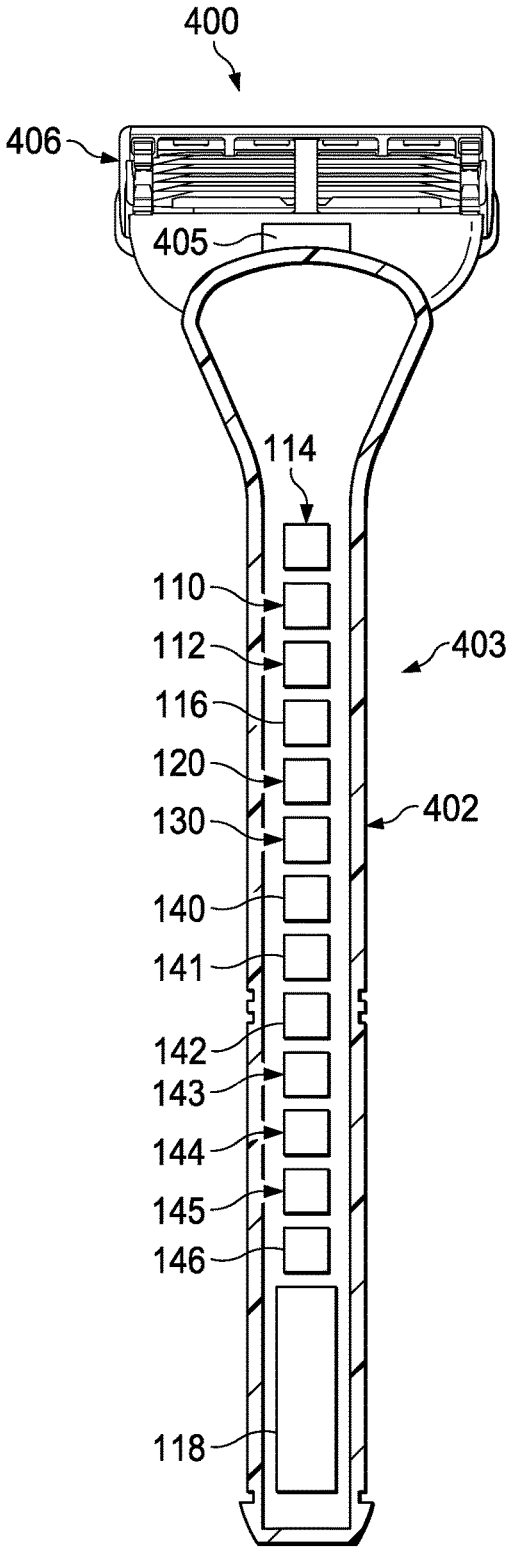
FIG. 8 is a cut away view of a handle for a personal appliance of the present invention.

Referring now to FIGS. 4 and 8, there is shown another personal appliance 400. Personal appliance 400 comprises a shaving razor 403. Shaving razor 403 comprises a handle 402. Shaving razor 403 includes razor cartridge 406 connected to implement connecting structure 405 of handle 402. Like the handle 202 shown in FIG. 6 handle 402 comprises an acceleration sensor 110 positioned in the handle; an angular velocity sensor 112 positioned in the handle; an implement displacement sensor 114 positioned in the handle; a communication device 116 positioned in the handle; a power source 118 positioned in the handle, and a magnetic field sensor 120 positioned in the handle.

Handle 402 also comprises one or more additional devices and sensors that may be used individually or in any combination. Additional devices and sensors comprise at least one orientation sensor 130, a clock 140, a memory storage device 141, an on/off switch 142, at least one temperature sensor 143, a barometric pressure sensor 144, a RFID sensor 145 and a microprocessor 146.

Suitable clocks 140 comprise a crystal oscillator, a ceramic oscillator and an RC oscillator. The clock 140 measures a length of time for an event whether it be a single stroke, a time between strokes, and a total shave time.

Suitable memory storage devices 141 comprise a non-volatile flash memory, a non-volatile flash memory card, a hard disk and/or a volatile DRAM.

The on/off switch 142 can be used to control power from the power source to any device and sensor needing power to operate. The on/off switch can control power from the power source to the acceleration sensor, the angular velocity sensor, the magnetic field sensor, the implement displacement sensor, the communication device and any other device and sensor. Suitable on/off switches comprise a mechanical switch, and electronic switch, a capacitive sensor, an accelerometer based trigger, a magnetic reed switch, an optical sensor, and an acoustic sensor.

Suitable temperature sensors 143 comprise a thermistor and a thermocouple. The temperature sensor can be used to measure the temperature of the handle and the head, such as a razor cartridge, attached to the head.

The additional devices and sensors can be used with the previously identified devices and sensors to collect data on a wide variety of attributes taking place during the shaving event. In use, the user will grasp handle 402 of shaving razor 403. The power source 118 will power up and power the sensors needing power. The power source 118 may power up automatically upon contact with or movement by the user. Alternatively, the power source 118 may power up via on/off switch 142. Alternatively, the power source 118 may be constantly on and preferably in a power save mode while not in use and then in full power mode when in use. The user will then shave with shaving razor 403. The user will then shave with shaving razor 403. As the user shaves data is collected from the acceleration sensor 110, the angular velocity sensor 112, the implement displacement sensor 114, the magnetic field sensor 120, and the orientation sensor 130. If included data may also be collected from clock 140, at least one temperature sensor 143, barometric pressure sensor 144 and RFID sensor 145. The data collected may include pitch, roll, yaw, orientation, time data, temperature data, barometric pressure data, RFID data as well as contact data. When the user is finished shaving the shaving razor 403 is put down and data collection stops.

The collected data may be transmitted instantaneously as the data is collected via the communication device 116. Alternatively, the collected data may be stored in memory storage device 141. The collected data may be transmitted from memory storage device after the data from a single shaving event or multiple shaving events has been collected via the communication device 116.

Figure 9:
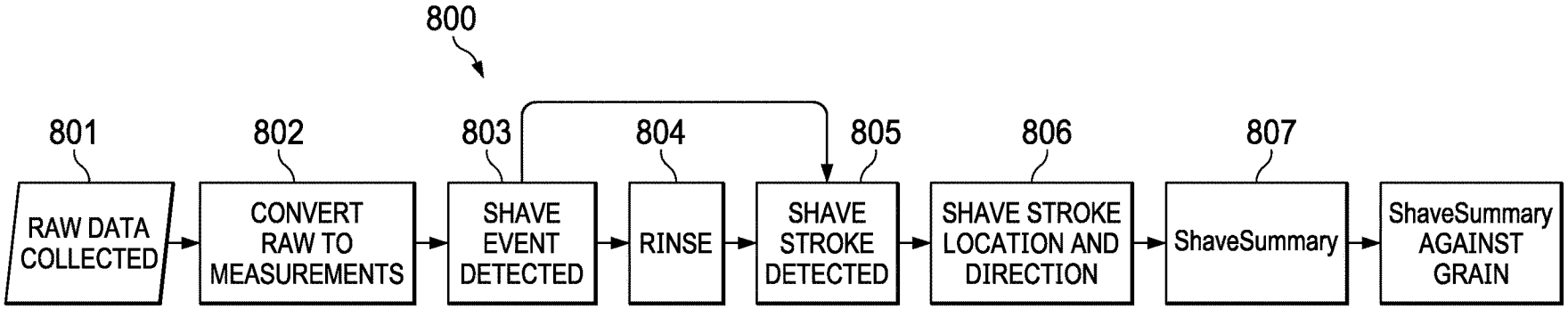
FIG. 9 is a plan diagram of collected shave data and associated algorithms.

Referring now to FIGS. 9 and 8 there is shown a plan diagram 800 of the collected data and algorithms used with handle 402 of shaving razor 403. After the handle 402 has been turned on via on/off switch 142, raw data is collected 801 during the shave from acceleration sensor 110, angular velocity sensor 112, implement displacement sensor 114, magnetic field sensor 120, orientation sensor 130, clock 140, temperature sensor 143, barometric pressure sensor 144 and RFID sensor 145. The raw data is stored in memory storage device 141. The raw data is then converted into measurements at 802. The measurements may be made by a logistics device such as microprocessor 146. Alternatively, the raw data can be sent from communication device 116 to an external device such as a mobile phone, a computer application, a computer or electronic device.

At 803 the shave event is detected from the raw data of the acceleration sensor 110, angular velocity sensor 112 and implement displacement sensor 114, and/or barometric pressure sensor 144 using an algorithm. The algorithm may comprise of monitoring a pressure reduction from barometric pressure sensor 144 in combination with activity strength as recorded by implement displacement sensor 114 or angular velocity sensor 112 or acceleration sensor 110. For example, if a user starts shaving there would be a drop in pressure value as detected by barometric pressure sensor 144 indicating that the user moved shaving razor 403 from a starting surface to the user's face and there would be activation of the implement displacement sensor 114 when shaving razor 403 touches the skin on the user's face. With activation of barometric sensor 144 without activation of implement displacement sensor 114 the event would be rejected as a shave. The same logic can be used to determine if razor cartridge 406 has been ejected by looking for a signal on implement displacement sensor 114. Also, it can be understood that time between signals and events can be used to determine actions like re-application of shave cream.

At 804 a rinse of the razor cartridge 406 can be detected from the raw data of the acceleration sensor 110, angular velocity sensor 112, implement displacement sensor 114, and/or the barometric pressure sensor 144 using an algorithm. A simple algorithm such as a decision tree (or ensemble of trees), logistic regression, or a recurrent neural network (RNN) can be trained by supervised learning to predict rinse versus no rinse using one or more of the sensor inputs. In some cases, like in RNN, raw sensor signals can be fed in to the train the model. In other cases like decision trees features like mean, standard deviations, etc. can be calculated to feed into the trained model for prediction.

At 805 a shave stroke can be detected from the raw data of the implement displacement sensor 114, acceleration sensor 110, angular velocity sensor 112, magnetic field sensor 120 and orientation sensor 130 using an algorithm. An algorithm looking at activation of implement displacement sensor 114 in combination with a certain activity level of angular velocity sensor 112 or acceleration sensor 110 to indicate expected motion that represents a shave stroke.

At 806 a shave stroke location and direction can be detected from the raw data of the implement displacement sensor 114, acceleration sensor 110, angular velocity sensor 112, magnetic field sensor 120 and orientation sensor 130 using an algorithm. An algorithm such as a decision tree (or ensemble of trees), logistic regression, or a recurrent neural network (RNN) can be trained by supervised learning to predict location on the user's face using one or more of the sensor inputs. In some cases, like in RNN, raw sensor signals can be fed in to train the model. In other case like decision trees features like mean, standard deviations, etc. can be calculated to feed into the trained model for prediction.

At 807 a summary of the shave can be generated from a combination of 802, 803, 804, 805, 806. 807 can also be fused with other information directly from the consumer to add an extra level of context such as which strokes were made in the direction of the hair grain. To do this, we would need information from either 802, 803, 804, 805, or 806 and the user input telling us what direction is their hair growing on a location of their face.

Figure 10:
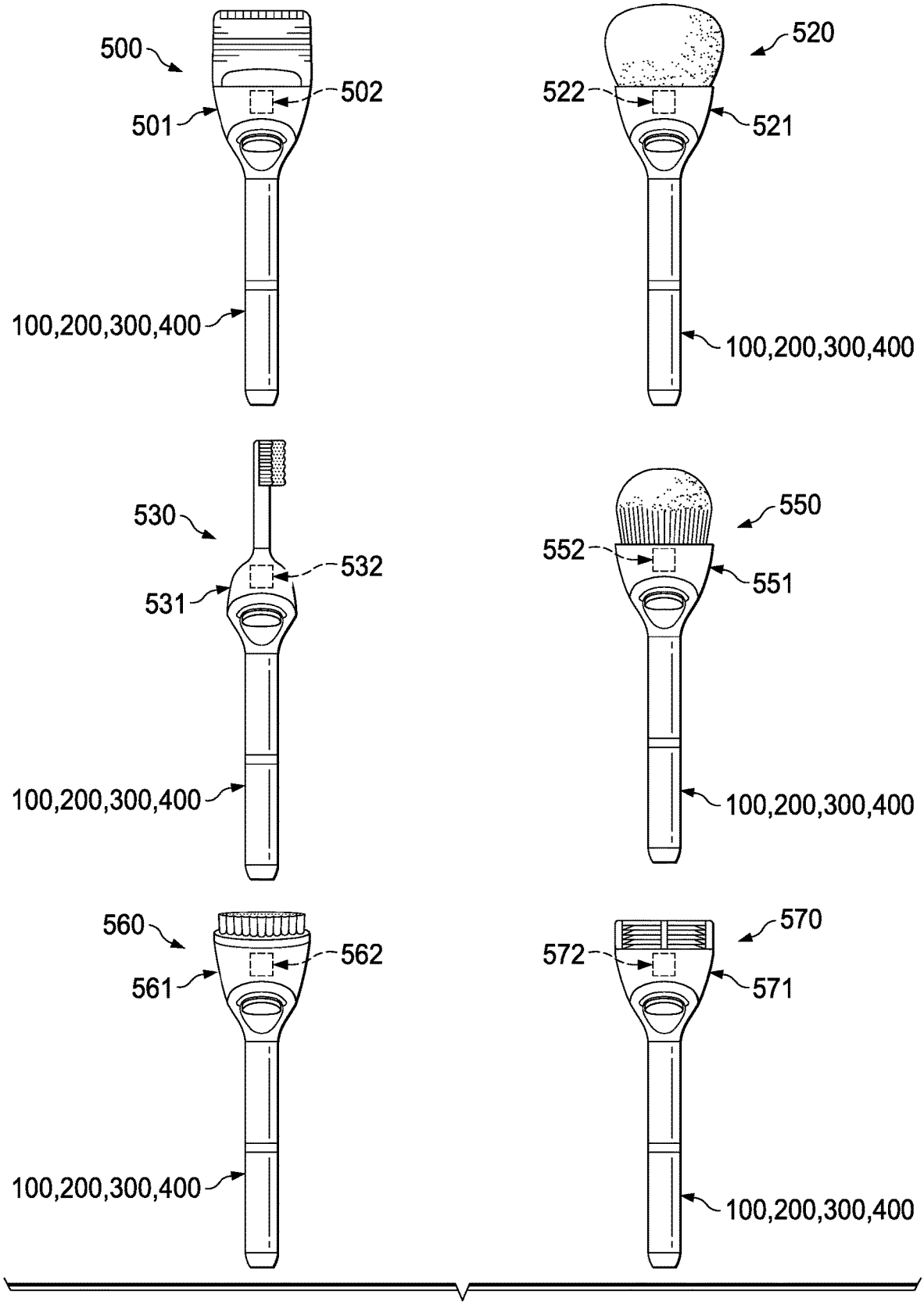
FIG. 10 is a view showing additional personal appliances.

Referring now to FIG. 10 there is shown additional personal appliances of the present invention such as an electric shaver 500, a body scrubber 520, an oral care device 530, a cosmetic appliance 550, a beauty appliance 560, and a shaving razor 570 such as previously described herein.

The electric shaver 500 comprises a handle 100, 200, 300, 400 and an implement 501 attached to the handle. The implement 501 cuts hair during shaving. The implement 501 may include a sensor 502 selected from any one of the sensors described above.

The body scrubber 520 comprises a handle 100, 200, 300, 400 and an implement 521 attached to the handle. Implement 521 scrubs the users skin during use. The implement 521 may include a sensor 522 selected from any one of the sensors described above.

The oral care 530 comprises a handle 100, 200, 300, 400 and an implement 531 attached to the handle. The implement 531 is used to clean teeth during brushing. The implement 531 may include a sensor 532 selected from any one of the sensors described above.

The cosmetic appliance 550 comprises a handle 100, 200, 300, 400 and an implement 551 attached to the handle. The implement 551 applies cosmetics. The implement 551 may include a sensor 552 selected from any one of the sensors described above.

The beauty appliance 560 comprises a handle 100, 200, 300, 400 and an implement 561 attached to the handle. The implement 561 is used for beauty applications. The implement 561 may include a sensor 562 selected from any one of the sensors described above.

The shaving razor 570 comprises a handle 100, 200, 300, 400 and an implement 571 attached to the handle. The implement 571 is used for cutting hair. The implement 571 may include a sensor 572 selected from any one of the sensors described above.

An example is below:

A. A personal appliance comprising:

a. a handle comprising an implement connecting structure;

b. an implement connected to the implement connecting structure;

c. an implement displacement sensor positioned in the handle, the implement displacement sensor measuring a displacement of the implement relative to a fixed position of the handle;

d. a power source positioned in the handle;

e. an acceleration sensor positioned in the handle;

f. an angular velocity sensor positioned in the handle; and g. a communication device positioned in the handle.

B. The personal appliance of paragraph A, wherein the acceleration sensor comprises an accelerometer.

C. The personal appliance of paragraph B, wherein the angular velocity sensor comprises a gyroscope.

D. The personal appliance of any one of paragraphs A-C, wherein a pitch and roll of the handle is calculated from the data from the acceleration sensor and angular velocity sensor.

E. The personal appliance of any one of paragraphs A-C, wherein a pitch, roll and yaw of the handle is calculated from data from the acceleration sensor and the angular velocity sensor.

F. The personal appliance of any one of paragraphs A-E further comprising a magnetic field sensor positioned in the handle.

G. The personal appliance of paragraph F, wherein the magnetic field sensor comprises a magnetometer.

H. The personal appliance of paragraph F, wherein a pitch, roll and yaw of the handle is calculated from the data from the magnetic field sensor, the acceleration sensor and the angular velocity sensor.

I. The personal appliance of any one of paragraphs A-H, wherein the implement displacement sensor comprises a magnetometer, an optical sensor, a switch, a Hall Effect sensor, a capacitive sensor, a load sensor or a displacement sensor.

J. The personal appliance of any one of paragraphs A-I, wherein the communication device comprises an LED display, an LCD display, a wireless connection, a wired connection, a removable memory card a vibration device, a microphone and/or an audio device.

K. The personal appliance of any one of paragraphs A-J, wherein the power source comprises a rechargeable battery, a disposable battery or a corded electrical connection.

L. The personal appliance of any one of paragraphs A-K, further comprising a clock positioned in the handle.

M. The personal appliance of paragraph L, wherein the clock comprises a crystal oscillator, a ceramic oscillator or an RC oscillator.

N. The personal appliance of any one of paragraphs A-M, further comprising a memory storage device positioned in the handle.

O. The personal appliance of paragraph N, wherein the memory storage device comprises non-volatile flash memory, a non-volatile flash memory card, a hard disk and/or a volatile DRAM.

P. The personal appliance of any one of paragraphs A-O, further comprising an on/off switch for controlling power from the power supply to the acceleration sensor, the angular velocity sensor, the magnetic field sensor, the implement displacement sensor and/or the communication device.

Q. The personal appliance of paragraph P, wherein the on/off switch comprises a mechanical switch, and electronic switch, a capacitive sensor, an accelerometer based trigger, a magnetic reed switch, an optical sensor, or an acoustic sensor.

R. The personal appliance of any one of paragraphs A-Q, further comprising at least one temperature sensor positioned in the handle.

S. The personal appliance of any one of paragraphs A-R, further comprising a barometric pressure sensor positioned in the handle.

T. The personal appliance of any one of paragraphs A-S, further comprising a RFID sensor positioned in the handle.

U. The personal appliance of any one of paragraphs A-T, wherein the personal appliance comprises a grooming appliance, a cosmetic appliance, a beauty appliance and an oral care appliance.

V. The personal appliance of any one of paragraphs A-U, wherein the implement comprises at least one sensor.

W. The personal appliance of any one of paragraphs A-V, wherein the communication device communicates with a second device.

X. The personal appliance of paragraph W, wherein the second device comprises a mobile phone, a computer application, a computer or an electronic device.

Y. The personal appliance of any one of paragraphs A-X, wherein the implement displacement sensor measures a linear displacement or a rotational displacement.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor comprising:

a. a handle comprising an implement connecting structure;

b. an implement connected to the implement connecting structure;

c. an implement displacement sensor positioned in the handle;

d. a follower positioned in the handle, the follower having a first end and an opposing second end, the first end of the follower being in contact with the implement and the second end of the follower being sensed by the implement displacement sensor, the follower converts rotational movement of the implement into a linear displacement, the linear displacement of the follower directly correlates to the rotational displacement of the implement Permitting the implement displacement sensor to measure a displacement of the implement relative to a fixed position of the handle;

e. a power source positioned in the handle;

f. an acceleration sensor positioned in the handle;

g. an angular velocity sensor positioned in the handle; and h. a communication device positioned in the handle.

2. The razor of claim 1, wherein a pitch and roll of the handle is calculated from data from the acceleration sensor and the angular velocity sensor.

3. The razor of claim 1, wherein a pitch, roll and yaw of the handle is calculated from data from the acceleration sensor and the angular velocity sensor.

4. The razor of claim 1, further comprising a magnetic field sensor positioned in the handle.

5. The razor of claim 4, wherein a pitch, roll, and yaw of the handle is calculated from data from the magnetic field sensor, the acceleration sensor and the angular velocity sensor.

6. The razor of claim 1, wherein the implement displacement sensor comprises a magnetometer, an optical sensor, a switch, a Hall Effect sensor, or a capacitive sensor.

7. The razor of claim 1, wherein the communication device comprises an LED display, an LCD display, a wireless connection, a wired connection, a removable memory card, a vibration device, a microphone, and/or an audio device.

8. The razor of claim 1, further comprising a clock positioned in the handle.

9. The razor of claim 1, further comprising a memory storage device positioned in the handle.

10. The razor of claim 1, further comprising at least one temperature sensor positioned in the handle.

11. The razor of claim 1, further comprising a barometric pressure sensor positioned in the handle.

12. The razor of claim 1, further comprising an on/off switch for controlling power from the power supply to the acceleration sensor, the angular velocity sensor, the magnetic field sensor, the implement displacement sensor and the communication device.

13. The razor of claim 1, wherein the on/off switch comprises a mechanical switch, an electronic switch, a capacitive sensor, an accelerometer based trigger, a magnetic reed switch, an optical sensor, or an acoustic sensor.

14. The razor of claim 1, wherein the implement comprises at least one sensor.

15. The razor of claim 1, wherein the communication device communicates with a second device.

16. The razor of claim 15, wherein the second device comprises a mobile phone, a computer application, a computer or an electronic device.

17. The razor of claim 1, wherein the personal appliance comprises a grooming appliance, a cosmetic appliance, a beauty appliance and an oral care appliance.

18. The razor of claim 1, wherein the implement displacement sensor measures a linear displacement or a rotational displacement.

* * * * *